United States Patent [19]

Seragnoli

[11] 4,398,438

[45] Aug. 16, 1983

[54] DEVICE FOR SIMULTANEOUSLY CUTTING TWO CONTINUOUS RODS OF CIGARETTE

[75] Inventor: Enzo Seragnoli, Bologna, Italy

[73] Assignee: G.D. Societa' per Azioni, Bologna, Italy

[21] Appl. No.: 308,669

[22] Filed: Oct. 5, 1981

[30] Foreign Application Priority Data

Dec. 12, 1980 [IT] Italy ..... 50352 A/80

[51] Int. Cl.[3] ..... A24C 5/28; B26D 1/56; B26D 3/16

[52] U.S. Cl. ..... 83/310; 83/339; 83/356.3; 83/594; 83/926 C; 131/65

[58] Field of Search ..... 83/310, 321, 341, 339, 83/594, 595, 926 C, 356.3; 131/65

[56] References Cited

U.S. PATENT DOCUMENTS 3,140,632 7/1964 Rowlands et al. ..... 83/310
3,782,229 1/1974 Cristiani ..... 83/310 X
3,815,460 6/1974 Bardenhagen ..... 83/310
3,830,126 8/1974 Ringe ..... 83/310

*Primary Examiner*—Frank T. Yost
*Attorney, Agent, or Firm*—Merriam, Marshall & Bicknell

[57] ABSTRACT

A device for simultaneously cutting two continuous rods of cigarette produced by a cigarette-making machine and disposed alongside one another on the same horizontal plane, the device being provided with a cantilever mounted cutting head facing the rods and upstream of the rod cut-off position, and provided with a rotary drum supporting at least one radial blade the position of which is adjustable with respect to the drum about a diametral axis thereof; the drum being mounted on a slide to oscillate about an axis which is perpendicular to the plane of the rods, intersects this at a point intermediate the rods and coincides, for a given position of the drum, with the adjustment axis of the blade, and the drum being connected by means of constant velocity joint to a drive shaft extending through the said slide.

5 Claims, 2 Drawing Figures

DEVICE FOR SIMULTANEOUSLY CUTTING TWO CONTINUOUS RODS OF CIGARETTE

BACKGROUND OF THE INVENTION

The present invention relates to a device for simultaneously cutting off two continuous rods of cigarette simultaneously produced by a cigarette-making machine and advancing side by side and substantially parallel to one another along a horizontal surface of the cigarette-making machine itself. In known cigarette-making machines producing a single rod of cigarette, the rod is normally made to advance until it reaches a cut-off region at which it is cut off by the operation of at least one blade carried by a drum of a cut-off device.

The said drum is mounted rotatably about an axis forming an angle with the axis of the rod, which angle is adjustable and is dependent on the length of the cigarette to be obtained. The above mentioned adjustment is necessary in that, as is very clearly explained in British Pat. No. 1 095 970, the blade must advance at the same speed as the rod while the cut is being made.

In a cigarette-making machine producing two rods of cigarette, the problems associated with cutting the rods are very much more complex than those which arise on a single-rod machine.

In fact, in the first place, a two-rod machine is comparable to a machine for the production of a single rod the diameter of which is equal to the inter axis between the two rods increased by the diameter of one of the two rods, and is of the order of 3–4 cm. The cutting of such a rod requires a perfect adjustment of the inclination of the blade-carrying drum in that the time during which each blade remains in contact with the rod is, in this case, very much greater than that which occurs on known machines producing a single rod of cigarette.

In the second place, it is not possible on a two-rod machine freely to position the blade-carrying drum about the rods since there are only two possible positions, that is to say above and below, seeing that only in these two positions are the rods equidistant from the adjustment axis of the drum and are therefore subjected to the same cutting conditions. The said two positions are to be considered as entirely equal to one another even though the embodiment described below of the device according to the invention employs a blade carrying drum above the two rods.

Finally, in a two-rod machine, the region disposed downstream of the cut-off position must remain completely uncluttered in order to permit an operator to intervene on both cut rods and in particular on that rod which is disposed furthest from the operator.

On machines producing a single rod of cigarette it is known to utilise cut-off devices which can be subdivided into two main categories.

In the first category belong cut-off devices (see for example British Pat. No. 324 379) in which the blade-carrying drum is connected to a drive shaft by means of a connection coupling between skew axes constituted by a cardan joint, and the inclination of the drum with respect to the drive shaft is adjusted by means of an arm extending from the drum in a direction opposite that of the drive shaft and carried by a slide movable along a curved guide.

In the second of the categories belong those cut-off devices (see for example British Pat. No. 1 238 459, in which the drum is keyed onto the drive shaft and oscillates together with this latter about an axis relatively spaced from the drum and normal to the direction of advance of the rod.

Known cut-off devices of the first category described above are not suitable to be used on a cigarette-making machine producing two rods of cigarette in that the whole of the device for adjustment of the inclination of the drum is disposed downstream of the cut-off region and would drastically reduce the access to the furthest rod of cigarette.

Known cut-off devices of the second category described above are, on the other hand, not suitable because if they were utilised on the two-rod machine they would not permit the cutting conditions of the two rods to be maintained the same upon adjustment of the inclination of the drum given that this latter oscillates about an axis spaced from the drum itself.

SUMMARY OF THE INVENTION

The object of the present invention is that of providing a cut-off device which will satisfy the previously described requirements of a machine producing two rods of cigarette. The said object is achieved by the present invention in that it relates to a device for the simultaneous cutting of two continuous rods of cigarette produced by a single cigarette-making machine alongside one another on the same plane, the device comprising a cutting head and a cutting reaction device supporting the said rods during cutting; the said cutting head being arranged facing the said rods and comprising a drive shaft substantially parallel to the said rods and a rotatable drum supporting at least one blade extending radially of the said drum and adjustable in position with respect to this latter about a radial axis thereof, the said drum being connected to the said drive shaft by means of a connection coupling between skew axes and being supported by a slide movable along a cylindrcally movable guide to rotate with respect to the said rods about an axis of rotation passing through the said coupling and perpendicular to the plane of the rods themselves; characterised by the fact that the said coupling is a constant velocity joint and the said drive shaft extends through the said slide; the said axis of said rotation intersecting the plane of the rods at a point equidistant between the rods themselves and being coplanar with the said axis of adjustment of the said blade, and the said drive shaft being connected to the said cutting reaction device by transmission means.

BRIEF DESCRIPTION OF THE DRAWINGS

Further characteristics and advantages of the present invention will become apparent from the following description with reference to the attached drawings, which illustrate a non limititive embodiment of it, in which.

DETAILED DESCRIPTION OF THE INVENTION

Figure 1:
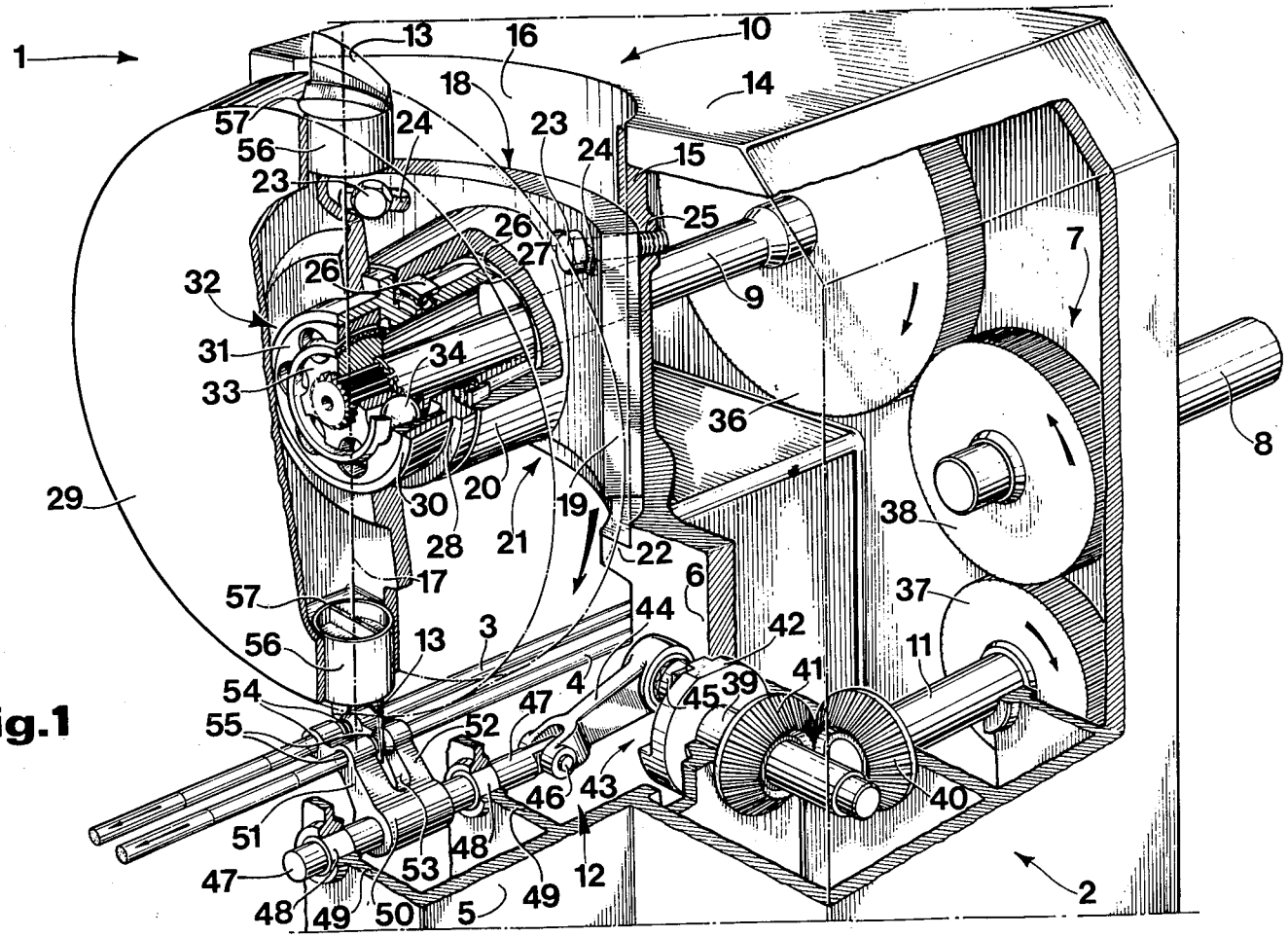
FIG. 1 is a perspective view, with parts in section and parts removed for clarity, of a cutting device formed according to the principles of the present invention.
Figure 2:
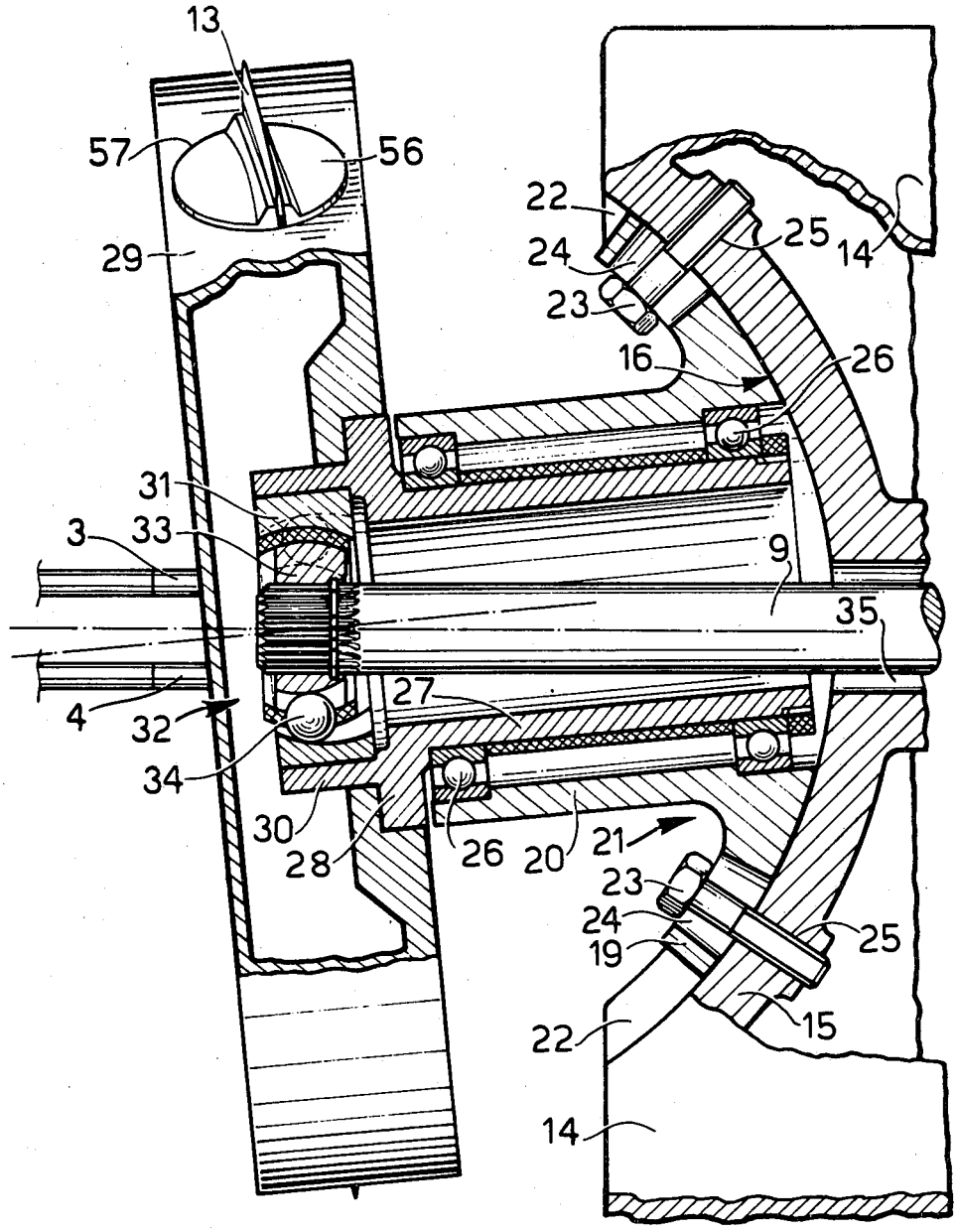
FIG. 2 is a plan view, partially in section, of a detail of FIG. 1.

In the above listed figures there is illustrated a cutting device generally indicated 1 which can be used on a cigarette-making machine 2 of the two-rod type, that is to say a machine capable of producing at its output two continuous rods 3 and 4 which are simultaneously cut by the device 1 to form a plurality of individual cigarettes.

The two rods 3 and 4, once formed, advance alongside and parallel to one another, on a horizontal plane above a base 5 of the machine 2, which supports laterally of the rods 3 and 4, a pedestal 6 of the cutting device 1. Within the pedestal 6 the cutting device 1 includes a gear transmission 7 which is connected to a drive shaft 8 and has two outputs the first of which is constituted by a shaft 9 for driving a cutting head 10, and the second of which is constituted by an input shaft 11 to a cutting reaction device 12 operable to cooperate with the rods 3 and 4 and with the blades 13 carried by the head 10 to guarantee a cut without tearing of the rods 3 and 4.

The head 10 includes a box 14 supported by a pedestal 6 and projecting out over the rods 3 and 4. The box 14 is laterally delimited by a wall 15 having a concave outer surface 16 consisting of a section of cylindrical surface the axis of which, indicated 17, is disposed vertically and intersects the plane passing through the axis of the rods 3 and 4 at a point equidistant between the said two axes and located downstream of the surface 16 with reference to the direction of movement of the rods 3 and 4.

To the surface 16 there is coupled, in a slidable manner, a convex surface 18 constituting the outer surface of a cylindrically movable plate 19. From the middle of the concave inner surface of the plate 19 there extends radially a tubular body 20. This latter and the plate 19 are integral with one another and constitute a slide 21 slidable on the surface 16. The plate 15 is provided at its lower end with a flange 22 of annular form which projects radially inwardly of the surface 16 and constitutes an abutment and sliding guide for the slide 21 preventing movements thereof parallel to the axis 17.

The slide 21 can be locked in position on the plate 15 by means of a pair of screws 23 the stems of which engage in a slidable manner in respective slots 24 passing through the plate 19, and the threaded ends of which engage in respective threaded holes 25 formed in the plate 15.

Within the tubular body 20 there are formed two grooves each housing the outer ring of a respective radial bearing 26 for supporting a sleeve 27 rotatably mounted within the tubular body 20 and axially fixed to this latter by means of a ring nut. The sleeve 27 has, outside the free end of the tubular body 20, an outer annular flange 28 rigidly connected to a flat outer surface of a cylindrical drum 29 supporting the blade 13.

From the upper surface of the flange 28 facing the drum 29 there extends axially a second sleeve 30 within the interior of which there is fixed the grooved outer ring 31 of a Rzeppa constant velocity joint 32 traversed by the axis 17 and disposed within the drum 29 substantially at the position of the center of gravity. The inner grooved ring 33 of the coupling 32 is similarly coupled to the ring 31 by means of balls 34 and is keyed onto the end of the shaft 9. This latter extends through the sleeve 27 and penetrates into the box 14 through a hole 35 coaxial with it and substantially parallel to the axes of the rods 3 and 4.

The end of the shaft 9 located within the box 14 carries, keyed on it, a toothed wheel 36 forming a part of the transmission 7. This latter includes, as well as the toothed wheel 36 a toothed wheel 37 keyed to the shaft 11 and angularly connected to the toothed wheel 36 by means of the inter-position of a toothed intermediate wheel 38 keyed on the drive shaft 8. The cutting reaction or resistance device 12 comprises, as well as the shaft 11, a second shaft 39 perpendicular to the shaft 11 and angularly coupled thereto by means of a pair of bevel gears 40 and 41. The shaft 39 extends horizontally within the base 5 beneath the horizontal plane of movement of the rods 3 and 4 and carries, keyed to one end, a disc 42 constituting the crank of a crank and connecting rod transmission the connecting rod 44 of which is eccentrically pivoted at 45 on the disc 42. The free end of the connecting rod 44 is pivoted at 46 to the end of a shaft or link 47 slidably mounted, by means of the interposition of sliding bearings 48, through two support plates 49 of the base 5. The shaft 47 is located horizontally and parallel to the rods 3 and 4, and supports a sleeve 50 in a position between the plates 49.

The sleeve 50 is rigidly connected to the shaft 47 and is provided with two radial projections 51 and 52 co planar with one another and separated by a slot 53 perpendicular to the rods 3 and 4. Each projection 51, 52 has a pair of through holes 54 and 55 coaxial, respectively with the holes 54 and 55 of the other projection.

The rods 3 and 4 pass through the pair of holes 54 and the pair of holes 55 respectively with slight radial play. The slot 53 is engaged in succession, upon each revolution of the drum 29, by each of the blades 13 which are rigidly connected to respective cylindrical inserts 56 engaged in a rotatable and angularly fixable manner (by means of stop means not illustrated) to the interior of respective radial recesses 57 formed on the outer periphery of the drum 29. In particular, the axes of the recesses 57, that is the axes of rotation of blades 13, are aligned with one another along a diameter of the drum 29 arranged in such a way as to coincide with the axis 17 at two given angular positions of the drum 29 spaced from one another by 180° and use of which is illustrated in FIG. 1.

In use, before being operated, the cutting head 10 must be accurately adjusted in dependence on the type of cigarette to be produced.

For this purpose the screws 23 are slackened in such a way as to permit the slide 21 to slide along the surface 16. After having newly fixed the slide 21 on the plate 15 in a position which, as previously indicated, is solely dependent on the length of cigarettes to be obtained, each insert 56 is locked within the associated recess 57 in a position such that, when its axis coincides with the axis 17 and its outer end faces the radial projections 51 and 52, the associated blade 13 shall be located perfectly perpendicular to the axes of the rods 3 and 4 and engaged in the slot 53.

At this point the head 10 is ready to operate and, following operation of the cigarette-making machine 2, and therefore, of the drive shaft 8, performs simultaneous cutting-off of the rods 3 and 4 into cigarettes the length of which is determined in a manner which can easily be deduced from FIG. 1 and which will not require further explanation.

It is however, suitable to state that the mounting of the shaft 9 through the tubular body 20 of the slide 21 permits the whole of the part of the machine disposed downstream of the drum 29 with reference to the direction of movement of the rods 3 and 4 to be entirely uncluttered facilitating possible intervention by an operator on the individual cigarettes from both the rods 3 and 4. Moreover, the use of a constant velocity joint 32 allowing the arrangement of the axis of oscillation of the slide 21 in a position not only perpendicular to the plane of the rods 3 and 4 and symmetrical with respect to these, but also co planar with the axes of the recesses 57, ensures identical cutting conditions for both the rods 3 and 4 independently of the inclination of the drum 29 with respect to these latter.

I claim:

1. A device for simultaneously cutting two continuous rods (3, 4) of a cigarette produced by a single cigarette-making machine (2) and arranged side by side with one another on the same plane, the device comprising a cutting head (10) and a cutting reaction device (12) supporting the said rods (3, 4) during cutting: the said cutting head (10) being positioned facing the said rods (3, 4) and including a drive shaft (9) substantially parallel to the said rods (3, 4) and a drum (29) rotatably supporting at least one blade (13) extending radially from the said drum (29) and adjustable in position with respect to this latter about an axis radially thereof, the said drum (29) being connected to the said drive shaft (9) by means of a coupling (32) connecting skew axes and being supported by a slide (21) movable along a cylindrical-path guide (16) to rotate with respect to the said rods (3, 4) about an axes of rotation (17) passing through the said coupling 32 and perpendicular to the plane of the rods (3, 4); characterised by the fact that the said coupling (32) is a constant velocity joint and the said drive shaft (9) extends through the said slide (21); said axis of rotation (17) intersecting the plane of the rods (3, 4) at a point equidistant between the rods themselves and being co planar with said axis of adjustment of the said blade (13), and the said drive shaft (9) being connected to the said cutting reaction device (12) by transmission means (7).

2. A device according to claim 1, characterised by the fact that the said constant velocity joint (32) is located within the said drum (29) in substantially the position of the centre of gravity.

3. A device according to claim 1, characterised by the fact that the said slide (21) comprises a cylindrical wall (19) slidably coupled to the said guide 16, and the tubular body (20) extends radially from a concave surface of the said wall (19); the said tubular body (20) being traversed by the said drive shaft (9) and rotatably supporting the said drum (29).

4. A device according to claim 3, characterised by the fact that the said drum (29) has rigidly connected thereto an axial sleeve (27) fitted within the interior of the said tubular body (20) and coupled thereto in a rotatable manner; the said sleeve (27) being transversed by the said drive shaft (9) and being angularly coupled thereto by means of the said constant velocity joint (32).

5. A device according to claim 1, characterised by the fact that the said constant velocity joint (32) is a RZEPPA joint.

* * * * *